US005445290A

United States Patent [19]

Forsythe et al.

[11] Patent Number: 5,445,290

[45] Date of Patent: Aug. 29, 1995

[54] STAND-ALONE COMBINATION ICE MAKER AND BEVERAGE DISPENSER

[75] Inventors: David P. Forsythe, Fenton; Dean A. Martin, Maryland Heights, both of Mo.

[73] Assignee: Multiplex Company, Inc., St. Louis, Mo.

[21] Appl. No.: 277,157

[22] Filed: Jul. 19, 1994

Related U.S. Application Data

[62] Division of Ser. No. 90,806, Jul. 12, 1993, Pat. No. 5,363,671.

[51] Int. Cl.[6] ..... B67D 5/62

[52] U.S. Cl. ..... 222/129.1; 222/146.6; 222/192; 62/197

[58] Field of Search ..... 222/129.1, 146.6, 192; 62/196.1, 197, 199, 200, 352

[56] References Cited

U.S. PATENT DOCUMENTS

| | | | |
|---|---|---|---|
| 1,801,536 | 4/1931 | Alexander et al. | 62/223 |
| 2,034,300 | 3/1936 | Kellogg | 62/141 |
| 2,039,556 | 5/1936 | Ruse | 257/205 |
| 2,125,261 | 7/1938 | Stern | 62/299 |
| 2,153,335 | 4/1939 | Martin | 62/448 X |
| 2,162,260 | 6/1939 | Kurpiewski | 62/128 |
| 2,187,389 | 1/1940 | Winkler | 62/390 X |
| 2,328,810 | 9/1943 | Johnson | 62/200 |
| 2,628,009 | 2/1953 | Idzi | 225/40 |
| 2,678,549 | 5/1954 | Campbell et al. | 62/141 |
| 2,956,418 | 10/1960 | McCann | 62/177 |
| 3,390,540 | 7/1968 | Brush | 62/200 |
| 3,434,299 | 2/1969 | Nussbaum | 62/199 |
| 3,464,228 | 9/1969 | Hitchcock | 62/448 X |
| 3,827,256 | 8/1974 | Wiesner | 222/146.6 |
| 3,892,335 | 7/1975 | Schroeder | 222/146.6 X |
| 3,904,085 | 9/1975 | Bartyan | 222/146.6 X |
| 3,913,349 | 10/1975 | Johnson | 62/352 |
| 4,009,593 | 3/1977 | Davis | 222/146.6 X |
| 4,034,571 | 7/1977 | Bollinger | 222/146.6 X |
| 4,201,558 | 5/1980 | Schwitters et al. | 222/146.6 X |
| 4,545,505 | 10/1985 | Mueller et al. | 222/146.6 |
| 4,580,410 | 4/1986 | Toya | 62/352 |
| 4,730,463 | 3/1988 | Stanfill | 62/399 |
| 4,843,827 | 7/1989 | Peppers | 62/352 |
| 5,127,551 | 7/1992 | Black et al. | 222/129 |
| 5,363,671 | 11/1994 | Forsythe et al. | 222/146.6 |

FOREIGN PATENT DOCUMENTS

| | | | |
|---|---|---|---|
| 3-100795 | 4/1991 | Japan | 222/146.6 |
| 1346590 | 2/1974 | United Kingdom | 62/390 |
| 2198218 | 6/1988 | United Kingdom | 222/146.6 |
| 2205638 | 12/1988 | United Kingdom | 62/390 |
| 2208918 | 4/1989 | United Kingdom | 62/390 |

*Primary Examiner*—Andres Kashnikow
*Attorney, Agent, or Firm*—Senniger, Powers, Leavitt & Roedel

[57] ABSTRACT

A modular beverage cooling and dispensing system comprising a plurality of beverage cooling and dispensing modules, and a single power module containing a single compressor for servicing all of the beverage cooling and dispensing modules. Each beverage cooling and dispensing module comprises a housing, a tank within the housing for holding a liquid, an evaporator in the tank for chilling the liquid, and at least one beverage conduit positioned in the tank for exposure to the chilled liquid to cool beverage flowing through the conduit. A dispensing head is connected to the beverage conduit for dispensing beverage. Refrigerant lines connect the compressor of the power module and the evaporators of the beverage cooling and dispensing modules. The power module is physically separate from the beverage cooling and dispensing modules so that the power module may be placed at a convenient location remote from the beverage cooling and dispensing modules.

4 Claims, 9 Drawing Sheets

STAND-ALONE COMBINATION ICE MAKER AND BEVERAGE DISPENSER

CROSS-REFERENCE TO RELATED APPLICATION

This is a division of application Ser. No. 08/090,806 filed Jul. 12, 1993 now U.S. Pat. No. 5,363,671.

BACKGROUND OF THE INVENTION

The present invention relates generally to beverage dispensers, and more particularly to such dispensers which use a water bath, ice bank system to effect the cooling of the beverage.

In water bath, ice bank cooling systems, it has been conventional to use a separate compressor for each water bath in the system, thus requiring multiple compressors for multiple water baths. Similarly, combined beverage dispensers and ice makers of conventional design have typically utilized more than one compressor, including one for the evaporator in each water bath used to chill the beverage, and one for the evaporator used to freeze the water to form the ice in the ice maker. This use of more than one compressor in the same refrigeration system is expensive. Moreover, the incidence of compressor failure increases when more than one compressor is used.

SUMMARY OF THE INVENTION

Among the several objects of this invention may be noted the provision of an improved ice maker and beverage dispenser; the provision of such an ice maker and beverage dispenser which uses only one compressor to decrease cost, increase efficiency and reduce the frequency of compressor failure; and the provision of such an ice maker and beverage dispenser having refrigeration components which provide for increased efficiency of the system.

Briefly, a stand-alone combination ice maker and beverage dispenser of the present invention comprises a housing, an ice making device having a series of compartments in which water is adapted to be frozen to form ice cubes, and an evaporator in the housing for freezing water in the compartments to form ice therein. The combination ice maker and beverage dispenser further comprises a beverage cooling and dispensing system comprising a tank in the housing for holding a liquid, an evaporator in the tank for chilling the liquid, and at least one beverage conduit positioned in the tank for exposure to the chilled liquid to cool beverage flowing through the conduit. At least one dispensing head is connected to the beverage conduit for dispensing beverage supplied via the beverage conduit to the dispensing head. A single compressor is located in the housing. Refrigerant conduit means in the housing connects the single compressor and the evaporators of the ice maker and the beverage cooling and dispensing system for flow of refrigerant from the compressor through the evaporators and then back to the compressor to effect a refrigeration cycle.

Other objects and features will be in part apparent and in part pointed out hereinafter.

BRIEF DESCRIPTION OF THE DRAWINGS

Corresponding parts are designated by corresponding reference characters and/or numerals throughout the several views of the drawings.

DETAILED DESCRIPTION OF PREFERRED EMBODIMENTS

Figure 1:
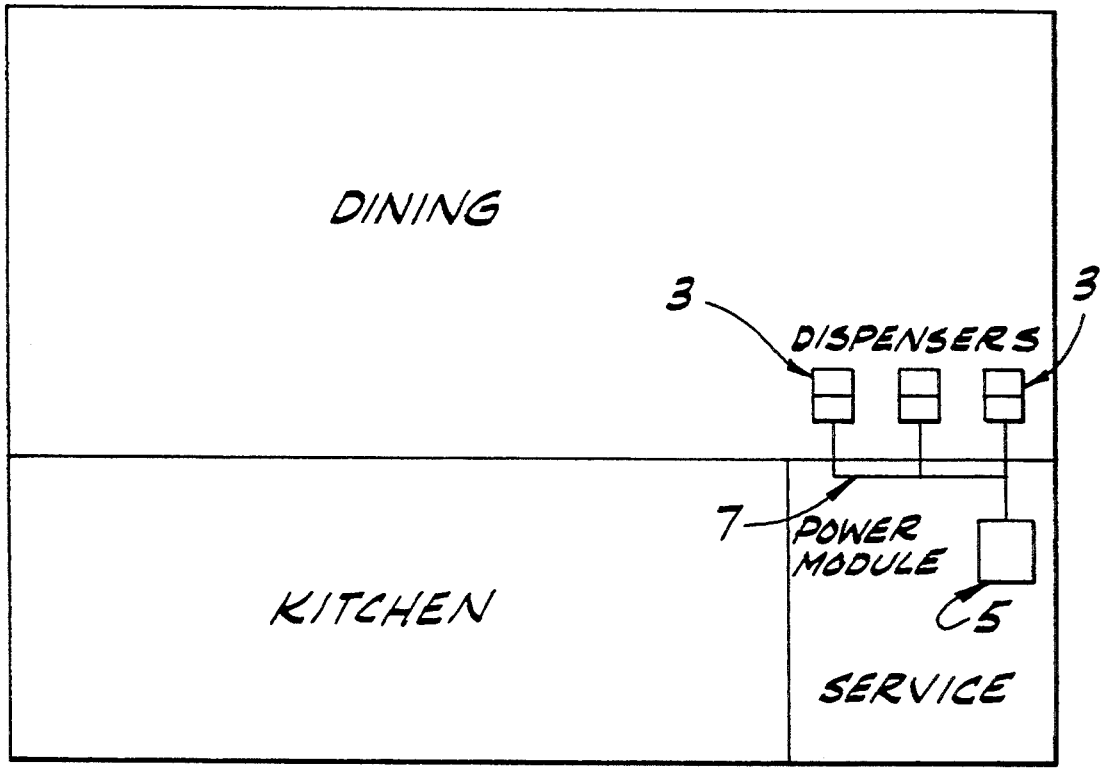
FIG. 1 is a diagrammatic view showing a beverage cooling and dispensing system of the present invention installed in a building.

Referring now to the drawings, and first to FIG. 1, there is generally indicated at 1 a modular beverage cooling and dispensing system of the present invention installed in a building having a dining area, a kitchen area, and a service area. The system comprises a plurality of beverage cooling and dispensing modules located in the dining area (three such modules, each generally designated 3, are shown in FIG. 1), and a power module, generally designated 5, in the service area. The beverage cooling and dispensing modules 3 are connected to the power module by refrigerant conduit means, generally indicated at 7, for flow of refrigerant between the modules to effect the refrigeration cycles necessary to cool the beverage dispensed by the dispensing modules, as will be explained in detail hereinafter. Because the power module 5 is physically separate from the beverage cooling and dispensing modules 3, it may be placed at a convenient location, such as the service area, remote from the beverage cooling and dispensing modules. As a result, the noise and heat associated with the power components of the refrigeration system are removed from the dispensing site. At the same time, the beverage is refrigerated at the dispensing site to eliminate the need for long insulated beverage lines.

Figure 2:
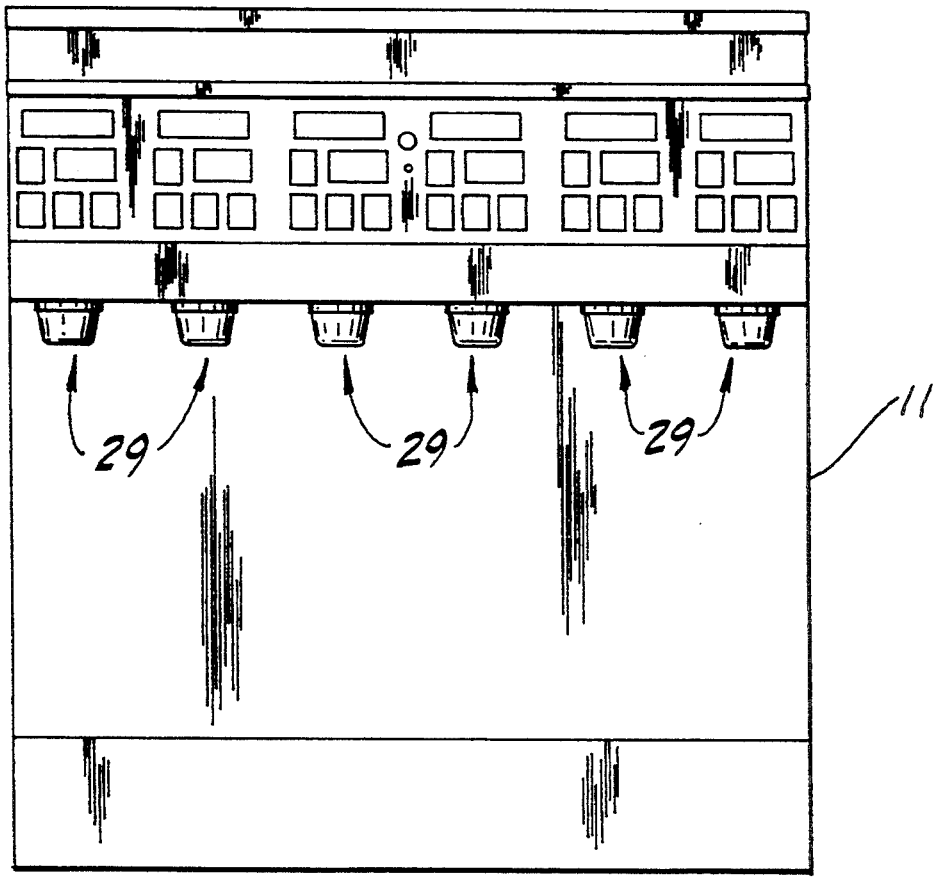
FIG. 2 is a front elevation of a beverage cooling and dispensing module of the system.
Figure 3:
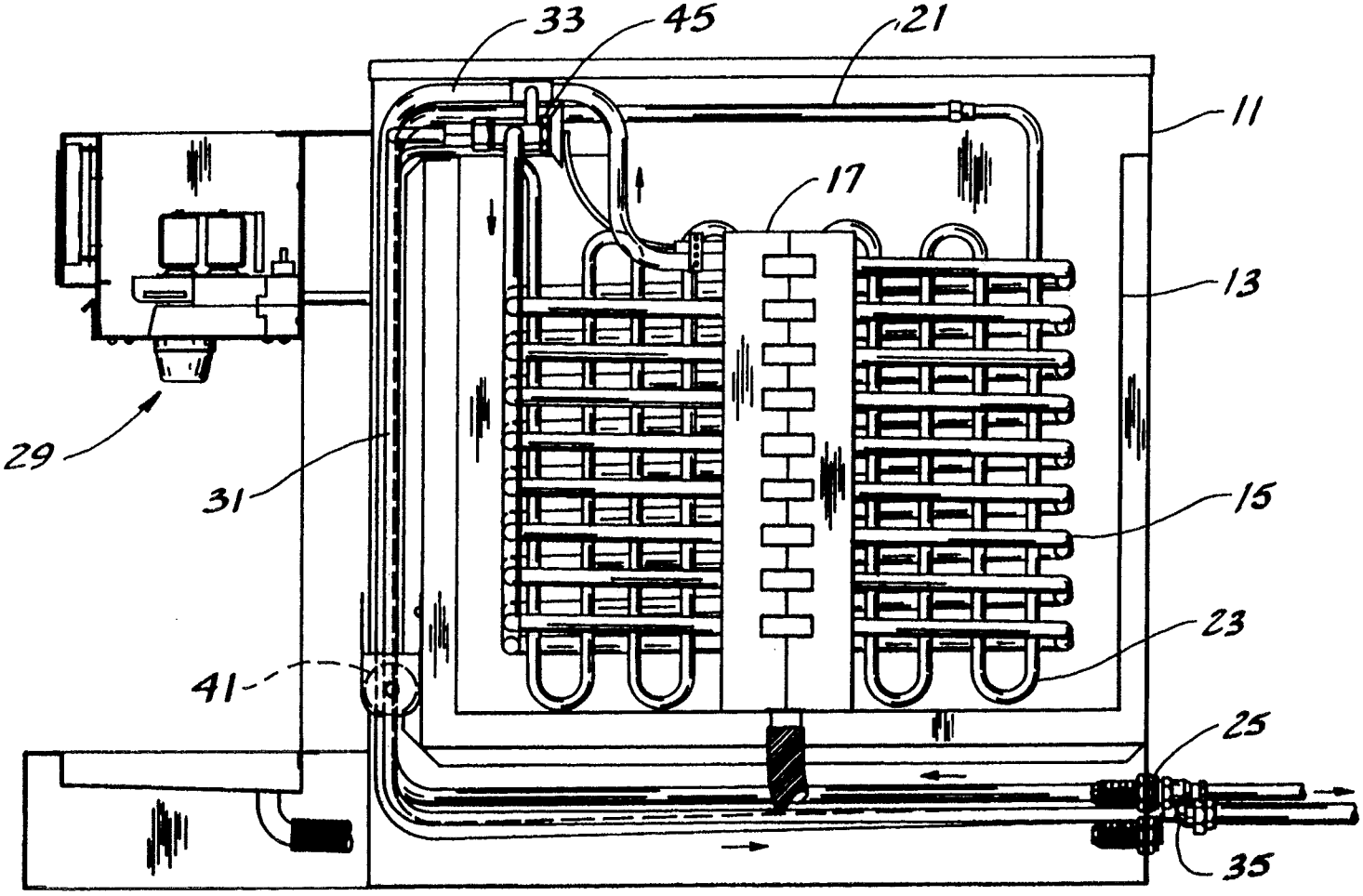
FIG. 3 is a side elevation of the module of FIG. 2 with parts removed to show interior details of the module.
Figure 4:
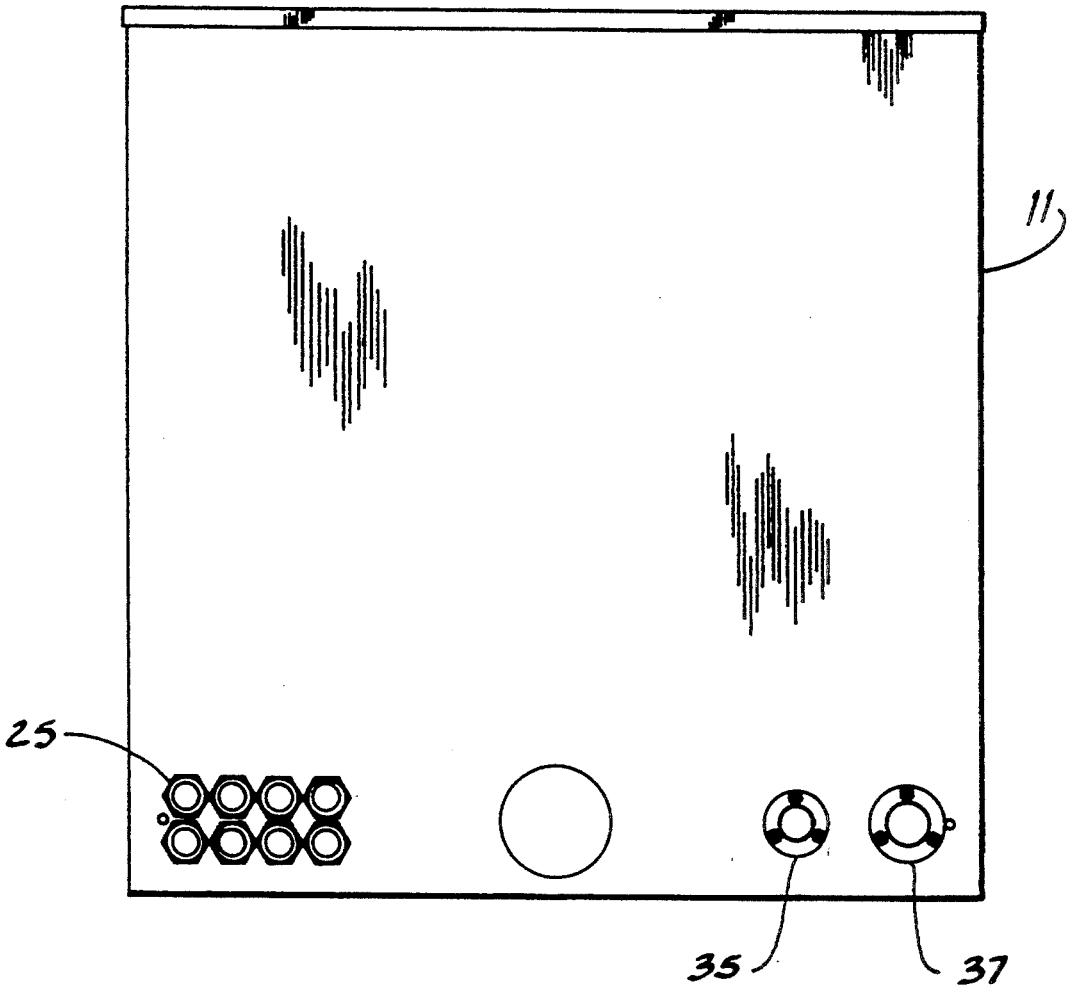
FIG. 4 is a rear elevation of the module of FIG. 2.

As best illustrated in FIGS. 2–4, each beverage cooling and dispensing module 3 comprises a housing 11, and a tank 13 within the housing for holding a liquid such as water to create what is referred to in the trade as a "water bath". An evaporator in the form of a coil 15 is supported in the tank 13 by means of a support 17 for chilling the liquid to form a coating of ice on the coil (referred to as an "ice bank"). Indicated at 21 is a beverage conduit or line having a section 23 of serpentine configuration positioned in the tank 13 for exposure to the chilled water bath thereby to cool the beverage flowing through the line. The beverage line 21 is connected at its inlet end to a fitting indicated at 25 attached to the housing 11, and at its outlet end to a dispensing head 29 for dispensing beverage supplied to the head. Typically, there are multiple dispensing heads 29, as shown in FIG. 2, each supplied by a separate beverage line. Only one dispensing head and its associated beverage line are shown in FIG. 3.

The evaporator coil 15 is connected at its inlet end to an inflow line 31 in the housing 11 which supplies refrigerant to the coil, and at its outlet end to an outflow line 33 in the housing for flow of refrigerant from the coil. The inflow and outflow refrigerant lines 31, 33 are connected to fittings indicated at 35 and 37, respectively, attached to the housing (FIG. 4). It will be understood that these refrigerant lines 31, 33 constitute part of the aforementioned refrigerant conduit means. A solenoid-operated valve 41 is installed in the inflow refrigeration line 31 in the housing for controlling the flow of refrigerant to the evaporator coil 15. This valve is operable in response to a sensor 43 (FIG. 7) in the tank 13 for sensing the build-up of ice on the evaporator coil 15. When this build-up reaches or exceeds a predetermined thickness, the sensor 43 generates a signal to close the valve 41 and thus shut off the supply of refrigerant to the coil. An expansion valve 45 is also provided in the inlet refrigerant line immediately upstream of the coil 15 for regulating the flow of refrigerant to the coil depending on the cooling requirements of the system for maximum efficiency. This expansion valve may be a thermal/electronic expansion valve, such as a valve commercially available from Sporlan Valve Company of St. Louis, Mo., part No. EBFVA-AA-CP85.

Figure 5:
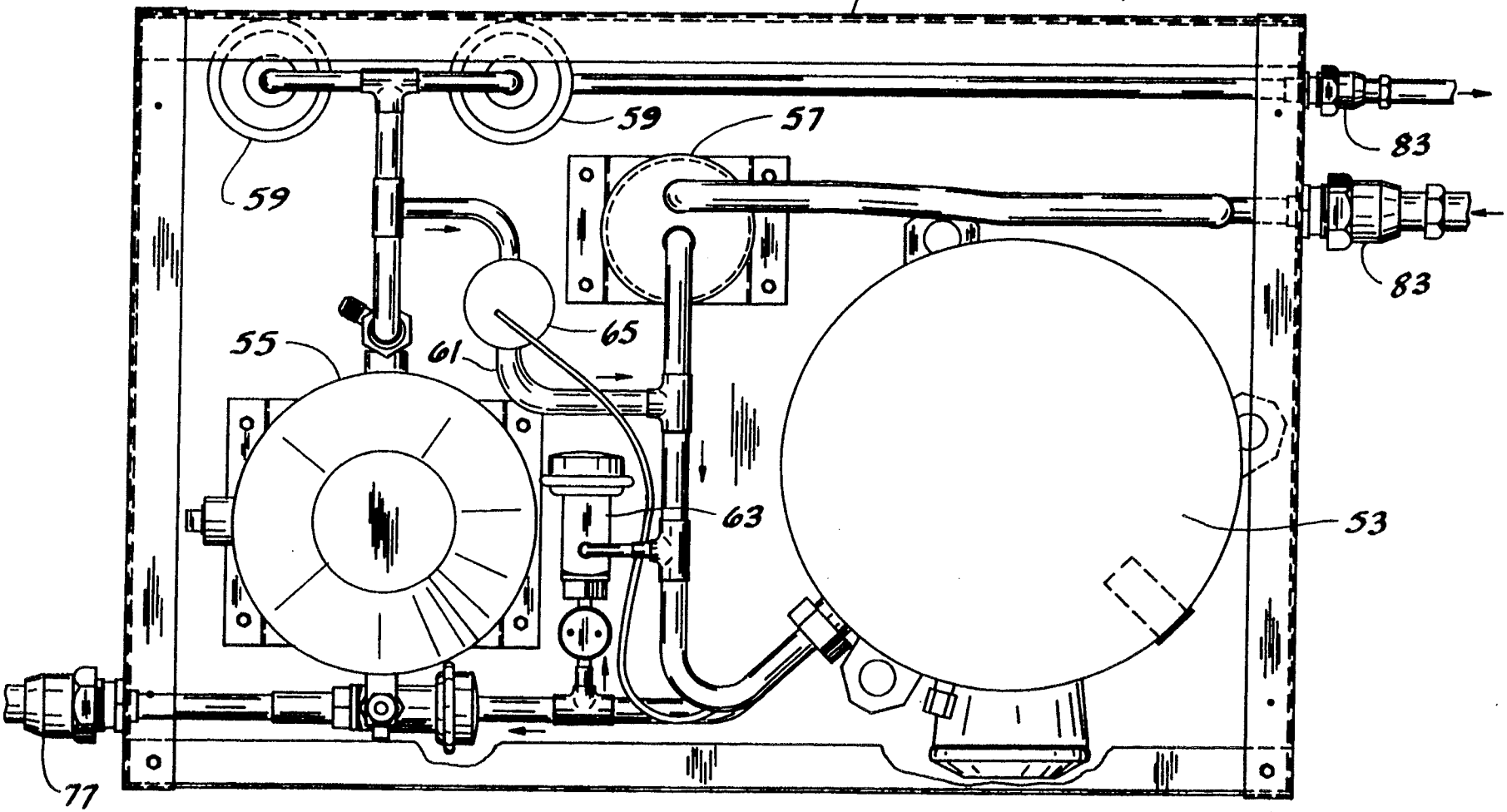
FIG. 5 is a plan view of a power module of the system, part of the housing being removed to show various components of the system.
Figure 6:
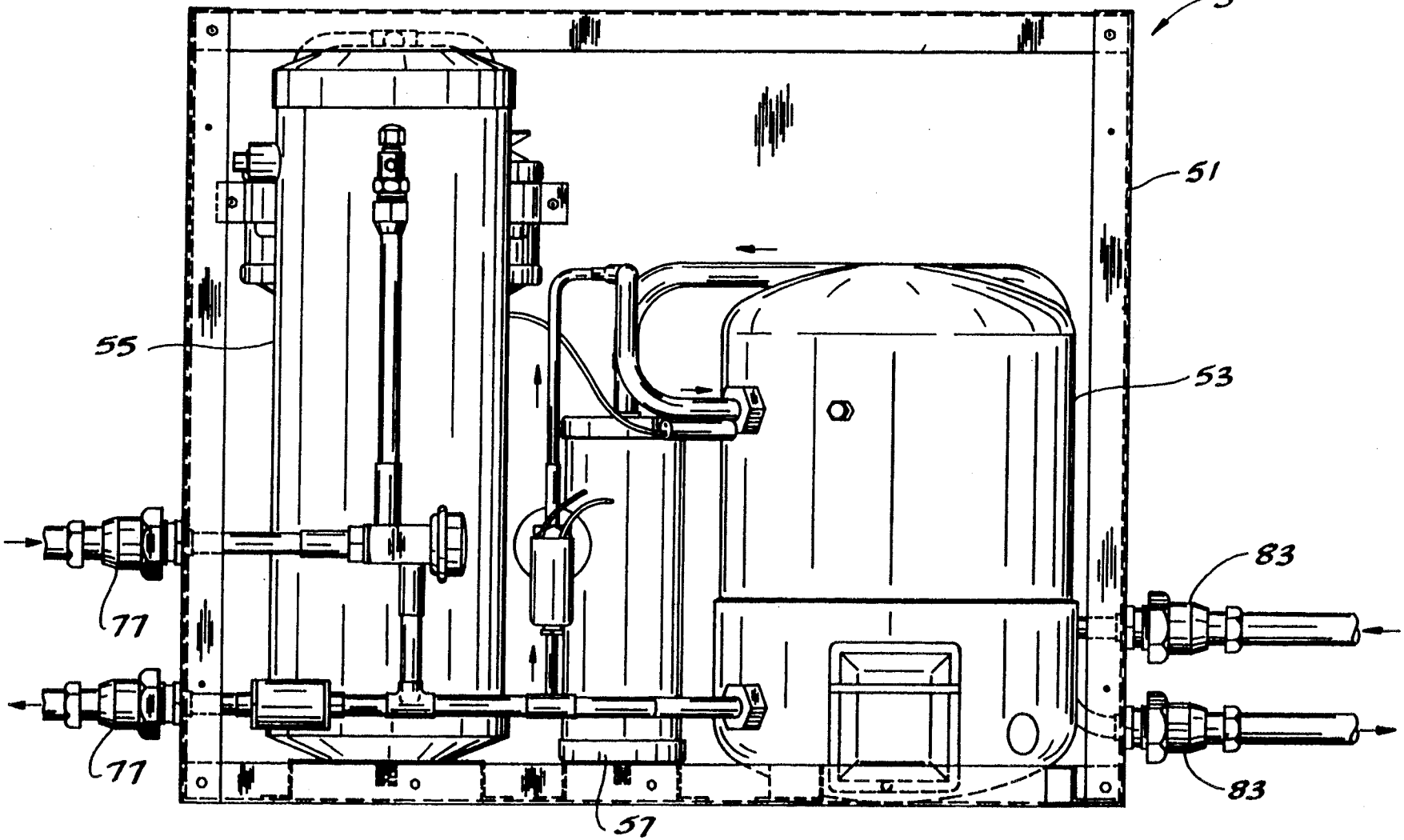
FIG. 6 is a side elevation of the power module with part of the housing being removed.
Figure 7:
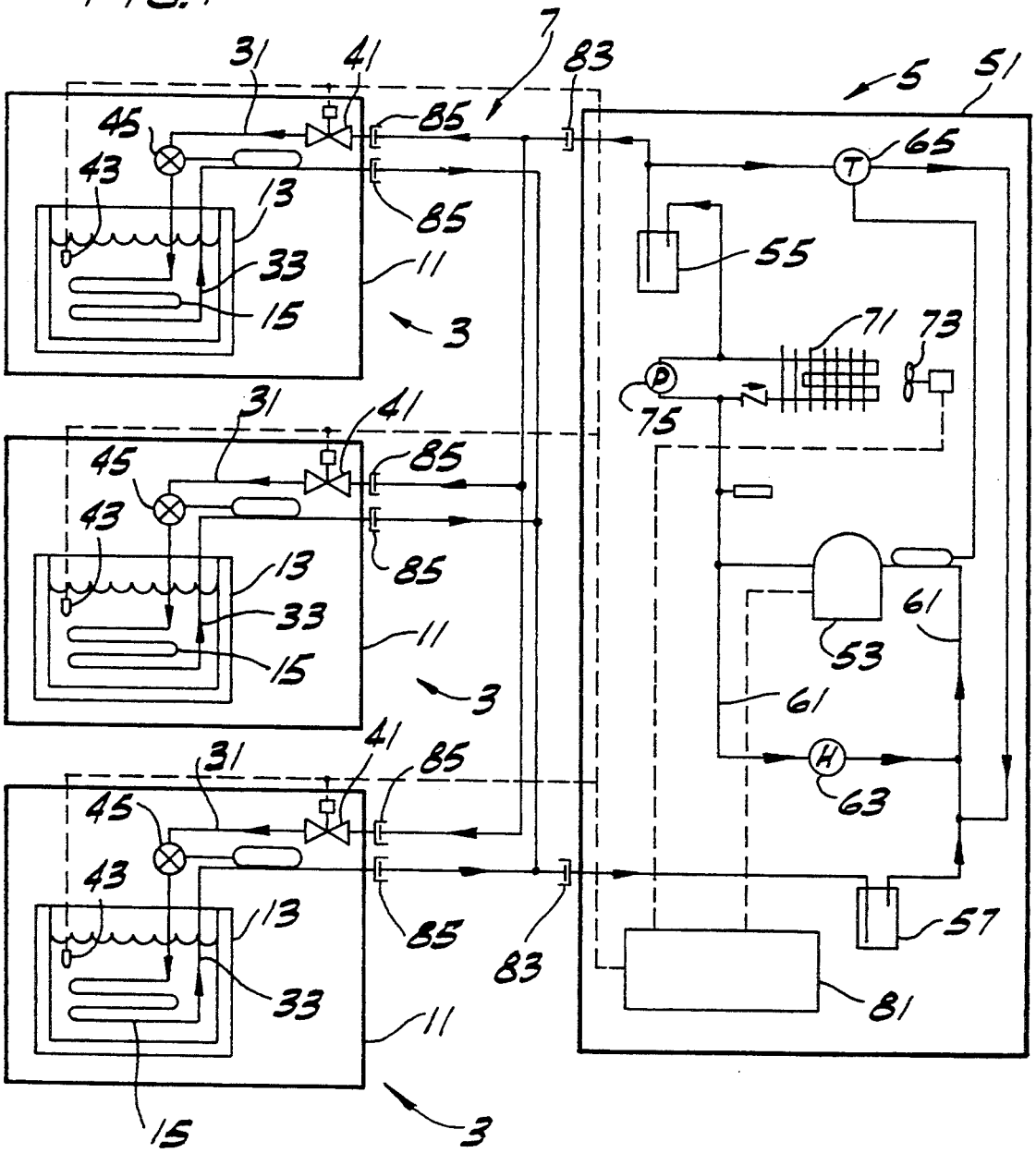
FIG. 7 is a schematic illustration of the refrigeration components of the system.

As shown in FIGS. 5–7, the power module 5 comprises a housing 51 of sheet metal or the like having a removable section to permit access to the interior of the housing. Located within the housing are a single compressor 53, a receiver 55, an accumulator 57, refrigerant dryers 59, and other standard power components of a refrigeration system. Since there is only one power module 5 in the system of this invention, the single compressor 53 is sized to meet the requirements of all of the cooling and dispensing modules, even when all have simultaneous cooling demands. Because the full capacity of the compressor is not always needed, precautions are taken to prevent overheating of the compressor during periods of low demand. Specifically, the power module 5 includes a hot gas bypass line 61 and regulator 63 for directing some of the gas flowing from the outlet of the compressor 53 back to the inlet of the compressor in the event the supply of refrigerant from the evaporator coils 15 of the beverage cooling and dispensing modules 3 to the inlet of the compressor drops below a predetermined amount (which can happen when the cooling requirements of the modules 3 are low). A desuperheating thermal expansion valve 65 is operable to introduce a liquid into the hot gas bypass line 61 to cool the gas flowing therethrough before it is introduced back into the compressor. This lowers the temperature of the refrigerant entering the compressor and serves to prevent overheating of the compressor during periods when refrigerant demand is low. A suitable regulator 63 and desuperheating thermal expansion valve 65 may be obtained from Sparlan Valve Company of St. Louis, Mo. (part Nos. ADRI-1-1/4-0/55 and EBFV-AA-L1, respectively).

In the embodiment shown in FIGS. 5 and 6, the condenser and fan (not shown) of the refrigeration system are located outside the housing 51 of the power module 5 at a remote location (e.g., the roof of a building), but it will be understood that these components can be located within the housing, as illustrated schematically in FIG. 7, where the condenser and fan are indicated at 71 and 73, respectively, and where the numeral 75 indicates a head pressure regulator. If these components are located outside the housing 51, the refrigerant lines leading to and from the condenser 71 can be connected to corresponding lines in the power module housing by means of quick-connect couplings, such as those indicated at 77 in FIGS. 5 and 6. Suitable electrical controls 81 for the refrigeration system are also located in the housing 51 for the power module 5.

To enable the modules 3, 5 to be conveniently removed from the system 1 for repair or replacement, the refrigerant lines connecting the power module 5 and the beverage cooling and dispensing modules 3 are coupled to respective modules by quick-connect couplings. The couplings connecting the lines to the power module are each indicated by the reference numeral 83 in the drawings, and the couplings connecting the lines to the beverage cooling and dispensing modules are each indicated by the reference numeral 85. These quick-connect couplings 83, 85 are preferably of the self-sealing type to prevent leakage when the two components of a coupling are connected and disconnected.

In operation, refrigerant flows from the compressor 53 in the power module 5 through respective refrigerant lines to the evaporators 15 in the beverage cooling and dispensing modules 3 to form an ice bank on each evaporator coil for chilling the water in the water baths. The chilled water, in turn, cools the beverage flowing through the beverage line 23 or lines in each module. The refrigerant then flows back to the power module, thereby effecting a refrigeration cycle, as will be understood by those skilled in this field. In the event the ice on an evaporator coil 15 thickens a predetermined amount, the sensor 43 generates a signal to close the solenoid-operated valve 41 to shut off further flow of refrigerant to the evaporator. When the thickness of the ice bank decreases to a predetermined thickness, as sensed by the sensor, a signal is generated to open the shut-off valve 41. The supply of refrigerant to the evaporators is also regulated by the expansion valves 45, which meter flow of the refrigerant to maximize efficiency of the system.

Figure 8:
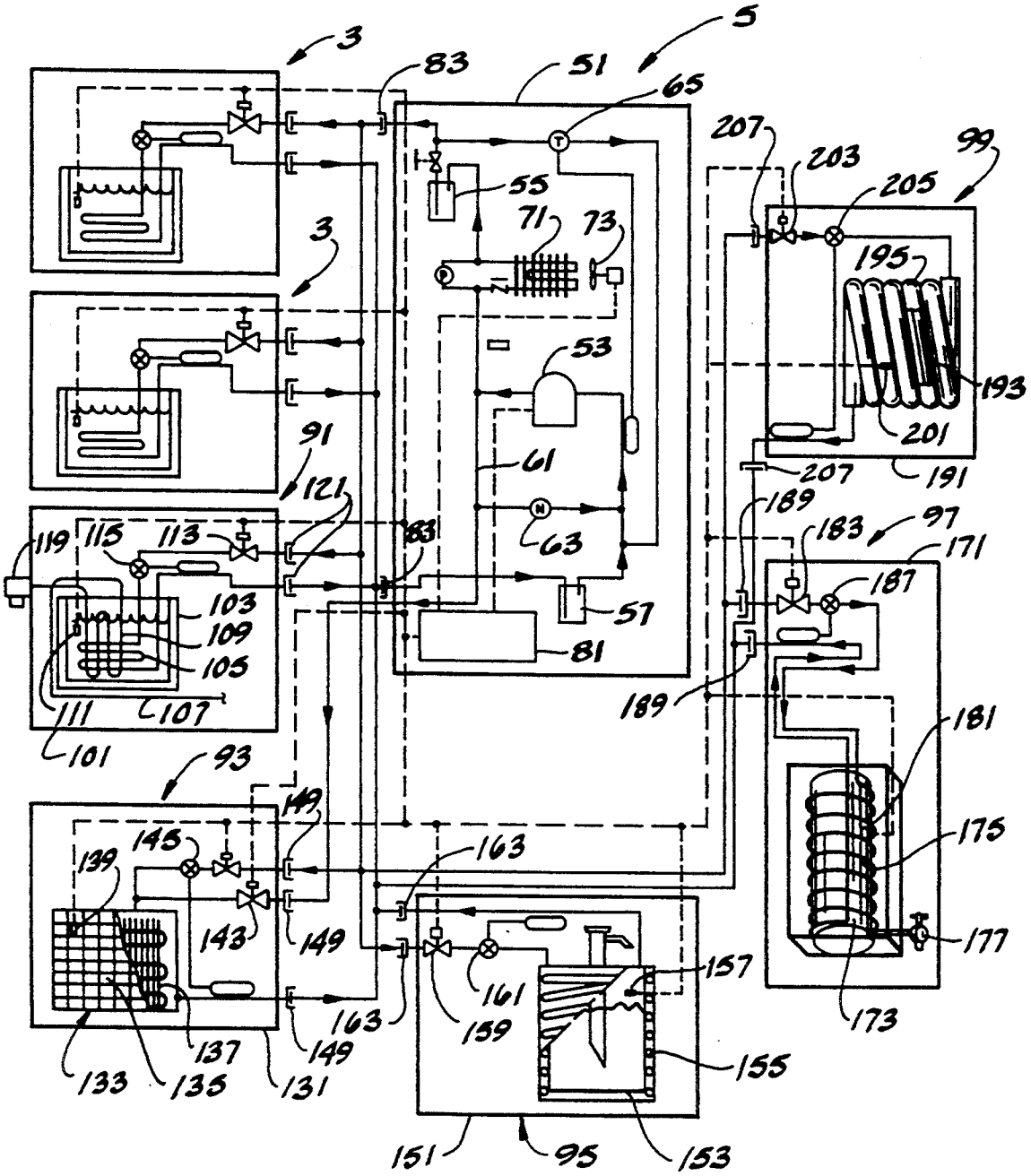
FIG. 8 is a view similar to FIG. 7 illustrating optional modules incorporated in the system of the present invention.

FIG. 8 illustrates a variation of this invention in which the beverage cooling and dispensing system includes a power module 5 and two beverage cooling and dispensing modules 3 of the type previously described, and several other "optional" modules. These "optional" modules include a beer cooling and dispensing module, generally indicated at 91, an ice making module generally designated 93, a condiment chilling module generally designated 95, an ice cream making module generally indicated at 97, and a water chilling module indicated in its entirety by the reference numeral 99. Each of these other modules is explained in more detail below.

The beer cooling and dispensing module 91 comprises a housing 101, a tank 103 within the housing for holding a liquid, such as a glycol-water mix to lower the freezing temperature of the liquid better to cool the beer, and an evaporator 105 in the tank for chilling the liquid in contact with the evaporator. At least one beer conduit 107 is provided having a section 109 positioned in the tank 103 for exposure to the cooling liquid bath to cool beer flowing through the conduit. The evaporator and beer conduit design is similar to the evaporator and beverage conduit design of module 3 described previously and includes a temperature sensor 111 for sensing the temperature of the liquid in the tank 103 and for generating a signal when the temperature decreases to a predetermined level. A solenoid-operated shut-off valve 113 is responsive to the signal from the sensor 111 to shut off further flow of refrigerant to the evaporator. When the temperature of the liquid bath increases to a predetermined level, as sensed by the sensor 111, a signal is generated to open the shut-off valve 113. An expansion valve 115 of the type previously described regulates flow of refrigerant to the evaporator to maximize efficiency of the refrigeration system. The module 91 also includes at least one dispensing head 119 connected to the beer conduit 107 for dispensing beer supplied via the beer conduit to the dispensing head.

Refrigerant lines (constituting part of the aforementioned refrigerant conduit means) connect the power module 5 and the beer cooling and dispensing module 91 for flow of refrigerant from the compressor 53 through the evaporator coil 105 and then back to the compressor to effect a refrigeration cycle. Like the beverage cooling and dispensing modules 3 previously described, the beer cooling and dispensing module is physically separate from the power module so that the power module may be placed at a remote but convenient location. Quick-connect couplings 121 are used to connect the refrigerant lines to fittings on the housing of the beverage cooling and dispensing module 91.

The ice making module 93 comprises a housing 131 and ice-making components in the housing, including a ice-cube forming device, generally designated 133, comprising a multiplicity of downwardly directed recesses or compartments 135 in which water is frozen to form ice cubes, and an evaporator 137 immediately adjacent the compartments 135 for cooling a supply of water to form ice in the compartments. The flow of refrigerant to the evaporator 137 is controlled in a manner similar to the previously described modules. An ice sensor 139 is provided for sensing the thickness of ice formed in the compartments 135 and for generating a signal when the cubes reach a predetermined thickness. A solenoid-operated shut-off valve 141 is responsive to a signal from the sensor 139 to shut off further flow of refrigerant to the evaporator 137. A second solenoid-operated valve 143 is operable to open after the first valve 141 closes to direct hot gas from the compressor 53 through the evaporator 137 to release the cubes from their compartments 135 and allow them to fall into an ice bin or other suitable collection device (not shown). As will be understood by those familiar with ice-making technology, the second valve 143 closes after a predetermined interval of time, after which the first valve 141 is adapted to open to allow the flow of refrigerant through the evaporator to form another batch of cubes. A thermal/electronic expansion valve 145 of the type previously described regulates the flow of refrigerant to the evaporator to maximize the efficiency of the refrigeration system. Because the ice making mechanism is conventional, the pump and associated lines for supplying water to the tray are not shown in FIG. 8.

Refrigerant lines (constituting part of the aforementioned refrigerant conduit means) connect the power module 5 and the ice making module 93 for flow of refrigerant from the compressor 53 through the evaporator 137 and then back to the compressor to effect a refrigeration cycle. As in the previous embodiments of this invention, the power module is physically separate from the ice making module so that the power module may be placed at a convenient location remote from the ice making module. Quick-connect couplings 149 are used to connect the refrigerant and hot gas lines to fittings on the housing 131 of the ice making module.

The condiment chilling module 95 comprises a housing 151, a receptacle 153 (e.g., a cylindric metal tub) in the housing for holding a supply of one or more condiments (e.g. relish, mustards, etc.), and an evaporator coil 155 in the housing 151 surrounding the receptacle for cooling the receptacle and the condiment therewithin. The flow of refrigerant to the evaporator is controlled in a manner similar to that previously described. A temperature sensor 157 senses the temperature of the receptacle 153 and generates a signal when the temperature decreases to a predetermined temperature. A solenoid-operated shut-off valve 159 is responsive to the signal from the sensor 157 to shut off further flow of refrigerant to the evaporator 155. When the temperature of the receptacle, as sensed by the sensor, rises above a predetermined temperature, the shut-off valve opens. A thermal/electronic expansion valve 161 of the type previously described regulates the flow of refrigerant to the evaporator 155 to maximize efficiency.

Refrigerant lines (constituting part of the aforementioned refrigerant conduit means) connect the power module 5 and the condiment chilling module 95 for flow of refrigerant from the compressor 53 through the evaporator coil 155 and then back to the compressor to effect a refrigeration cycle. Like the previous modules, the condiment chilling module is physically separate from the power module so that the power module may be placed at a convenient location remote from the condiment chilling module. Quick-connect couplings 163 are used to connect the refrigerant lines to fittings on the housing 151 of the condiment chilling module.

The ice cream making module 97 comprising a housing 171, a receptacle 173 in the housing for holding a supply of ice cream ingredients, and an evaporator coil 175 encircling the receptacle for cooling it and the ingredients therewithin. The ice cream making mechanism, which is of conventional construction, includes a dispenser 177 for dispensing the ingredients to make the ice cream. The flow of refrigerant to the evaporator 175 is controlled in a manner similar to that previously described. A temperature sensor 181 senses the temperature of the receptacle 173 and generates a signal when the temperature decreases to a predetermined temperature. A solenoid-operated shut-off valve 183 is responsive to the signal from the sensor to shut off further flow of refrigerant to the evaporator 175. When the temperature of the receptacle 173, as sensed by the sensor 181, rises above a predetermined temperature, a signal is generated to open the shut-off valve 183. A thermal/electronic expansion valve 187 of the type previously described regulates the flow of refrigerant to the evaporator to maximize efficiency.

Refrigerant lines (constituting part of the aforementioned refrigerant conduit means) connect the power module 5 and the ice cream making module 97 for flow of refrigerant from the compressor 53 through the evaporator coil 175 and then back to the compressor to effect a refrigeration cycle. As illustrated in FIG. 8, the power module 5 is physically separate from said ice cream making module 97 so that the power module may be placed at a convenient location remote from the ice cream making module. Quick- connect couplings 189 are used to connect the refrigerant lines to fittings on the housing 171 of the ice cream making module 97.

The water chilling module 99 comprises a housing 191, water conduit means 193 in the housing through which water is adapted to flow, and an evaporator 195 in the housing in heat transfer proximity to the water conduit means 193 for cooling water flowing therethrough. The water conduit means 193 and evaporator 195 are illustrated in FIG. 8 as being a tube-within-a-tube design, with the water conduit means comprising an inner tube and the evaporator comprising an outer tube surrounding the inner tube, the arrangement being such that the refrigerant flowing through the outer tube cools the water flowing through the inner tube. It will be understood that other configurations may also be suitable. For example, the evaporator and water conduit may be formed as separate passages through a unitary metal body, so that the evaporator and water conduit are in heat transfer relation with respect to one another to effect cooling of water flowing through the conduit. In any event, various water chilling arrangements are feasible and conventional.

The flow of refrigerant to the evaporator 195 of the water chilling module 99 is controlled in a manner similar to that previously described. A temperature sensor 201 senses the temperature of the water and generates a signal when the temperature decreases to a predetermined temperature. A solenoid-operated shut-off valve 203 is responsive to the signal from the sensor 201 to shut off further flow of refrigerant to the evaporator. A thermal/electronic expansion valve 205 of the type previously described regulates the flow of refrigerant to the evaporator 195 to maximize efficiency. Refrigerant lines (constituting part of the aforementioned refrigerant conduit means) connect the water chilling module 99 and the power module 5 for flow of refrigerant from the compressor 53 through the evaporator 195 and then back to the compressor to effect a refrigeration cycle. As noted, the power module is physically separate from the water chilling module so that the power module may be placed at a convenient location remote from the water chilling module. Quick-connect couplings 207 are used to connect the refrigerant lines to fittings on the housing 191 of the water chilling module.

It will be observed from the foregoing that any of the aforementioned modules 3, 5, 91, 93, 95, 97, 99 may be readily added to or removed from the system 1, thereby facilitating installation, maintenance and modification of the system. Furthermore, since only one compressor 53 is used to service all modules, the system configuration is simplified and the number of system components greatly reduced. Also, as discussed above, the modular nature of the present invention permits the "hot" components of the refrigeration system to be placed at a location or locations remote from the dispensing site, thereby reducing noise and heat at the dispensing site. At the same time, the water baths used to chill the beverage lines are located immediately adjacent the dispensing site, thereby avoiding the need for long insulated beverage lines associated with prior systems where the water baths are located at locations remote from the dispensing site.

Figure 9:
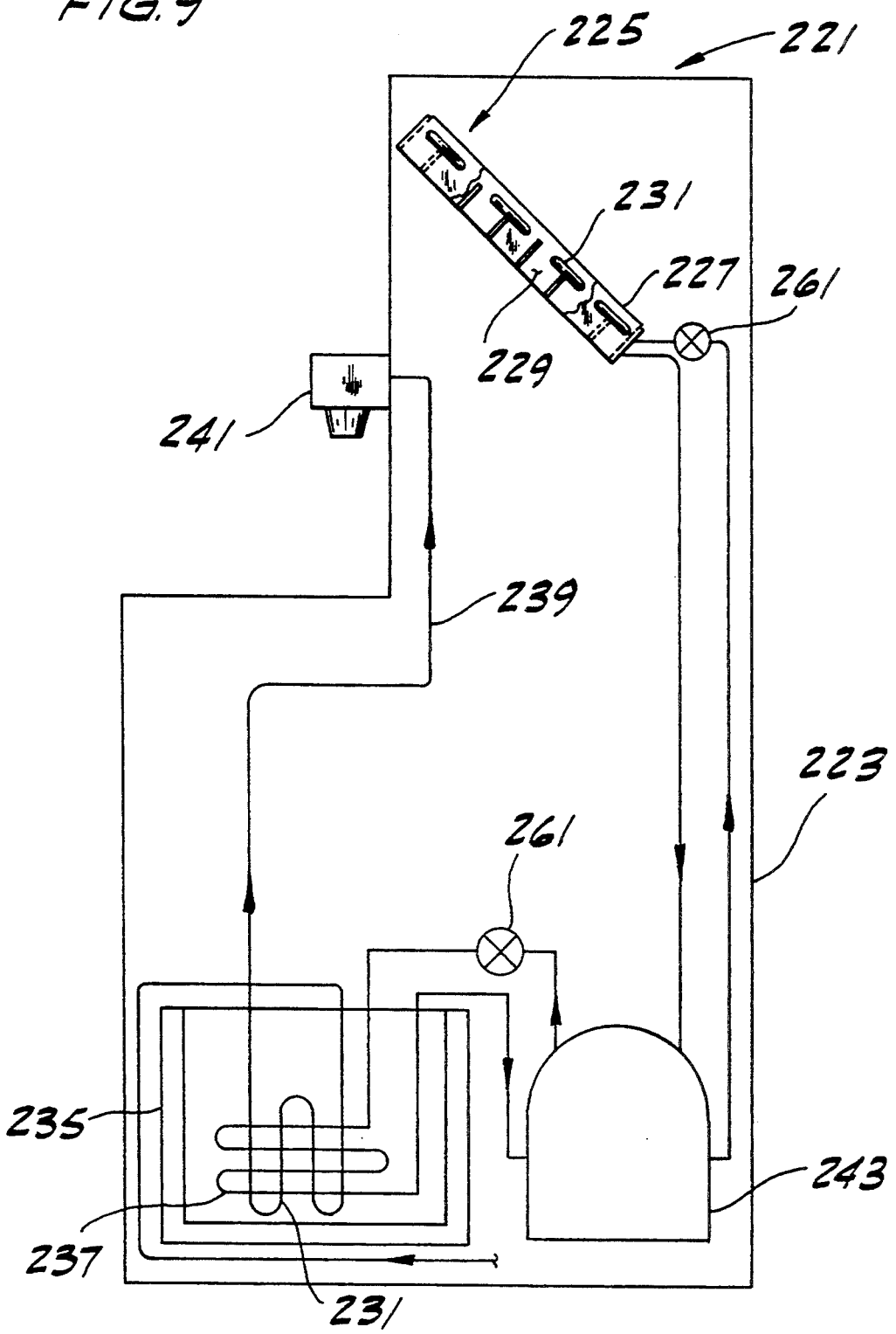
FIG. 9 is an elevational view of a stand-alone ice maker and beverage dispenser of the present invention, portions of the housing being removed to illustrate design details.
Figure 10:
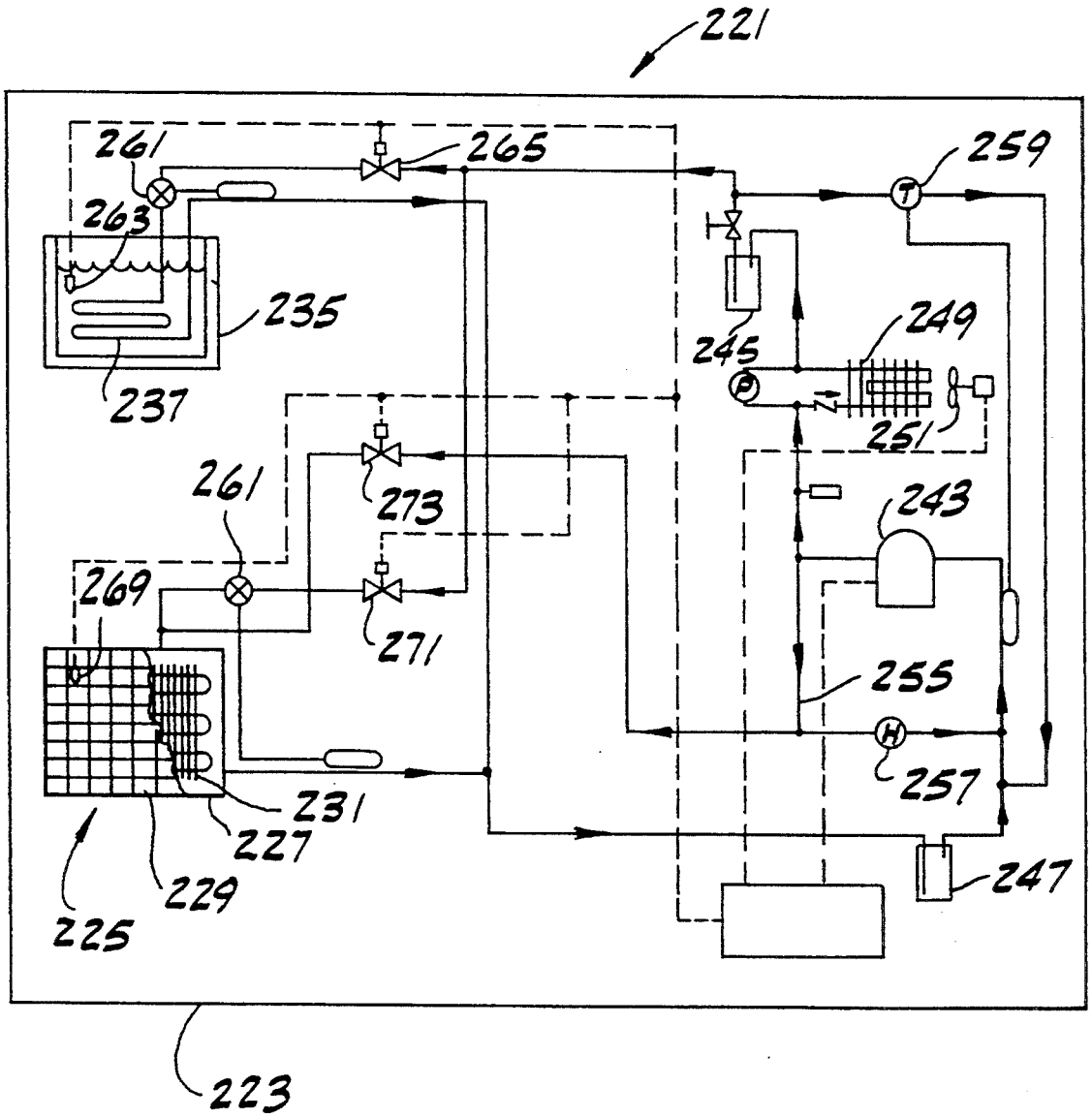
FIG. 10 is a schematic drawing of the refrigeration components of the ice maker and beverage dispenser of FIG. 9.

FIGS. 9 and 10 illustrate a stand-alone combination ice maker and beverage dispenser 221 of the present invention. As shown, the dispenser comprises a housing 223, and an ice maker, generally indicated at 225, in the housing of the type previously described, that is, one comprising an ice-making device 227 having a series of recesses or compartments 229 in which water is frozen to form ice-cubes, and an evaporator 231 for cooling water in the compartments to form ice cubes therein (the pump and associated lines for supplying water for this purpose are not shown).

The dispenser 221 also includes a beverage cooling and dispensing system comprising a water bath system of the type previously described. This system comprises a tank 235 in the housing 223 for holding a liquid, such as water, an evaporator 237 in the tank for chilling the liquid, and one or more beverage lines (conduits) 239 positioned in the tank for exposure to chilled liquid to cool beverage flowing through the lines. Only one such line is shown in FIG. 9. The dispenser also includes a dispensing head 241 connected to each beverage line 239 for dispensing beverage supplied via the line to the dispensing head. The tank 235, evaporator 237, beverage line(s) 239 and dispensing head(s) 241 may be identical to those described in connection with FIG. 3.

The stand-alone system includes a single compressor 243, a receiver 245, an accumulator 247, a condenser 249 and a fan 251, all located in the housing 223. Refrigerant lines or conduits in the housing connect the compressor 243 and the evaporators 231, 237 of the ice maker and water bath for flow of refrigerant from the compressor through the evaporators and then back to the compressor to effect a refrigeration cycle. Like the beverage cooling and dispensing system described previously, the stand-alone unit is provided with a hot gas bypass line 255 and regulator 257, and a desuperheating thermal expansion valve 259 operable to introduce a liquid into said hot gas bypass line to cool gas flowing therethrough (FIG. 10).

The flow of refrigerant to each evaporator 231, 237 in the stand-alone system is regulated by means of a thermal/electronic expansion valve 261. In addition, a sensor 263 is provided in the tank 235 of the beverage cooling and dispensing system adjacent the evaporator 237 for sensing the build-up of ice thereon and for generating a signal in the event such build-up exceeds a predetermined amount. Valve means comprising a solenoid-operated valve 265 is operable in response to such a signal for shutting off the flow of refrigerant to the evaporator. When the thickness of ice decreases beyond a predetermined thickness, as sensed by the sensor 263, the valve 265 is operable to open for continued flow of refrigerant to the evaporator. Similarly, a sensor 269 is provided adjacent the evaporator 231 of the ice maker 225 for sensing the thickness of ice formed in the compartments 229 and for generating a signal when the thickness of the cubes reaches or exceeds a predetermined thickness. A first solenoid-operated valve 271 is operable in response to such a signal for shutting off the flow of refrigerant to the evaporator 231. Like the ice-maker previously described, a second solenoid-operated valve 273 opens after the first valve 271 closes to direct hot gas from the compressor 249 through the evaporator 231 to release the cubes from their compartments 229 and allow them to fall into an ice bin or other suitable collection device. The second valve 273 closes after a predetermined interval of time, after which the first valve 271 is adapted to open to allow the flow of refrigerant through the evaporator to form another batch of cubes.

The use of a single compressor to service both an ice maker and a beverage cooling and dispensing system greatly simplifies the refrigeration system and reduces the instances of compressor failure compared to similar systems using multiple compressors.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A stand-alone combination ice maker and beverage dispenser, comprising a housing, an ice making device having a series of compartments in which water is adapted to be frozen to form ice cubes, and an evaporator in the housing for freezing water in the compartments to form ice therein, a beverage cooling and dispensing system comprising a tank in the housing for holding a liquid, an evaporator in the tank for chilling said liquid, at least one beverage conduit positioned in the tank for exposure to chilled liquid to cool beverage flowing through the conduit, and at least one dispensing head connected to said at least one beverage conduit for dispensing beverage supplied via said beverage conduit to said dispensing head, a single compressor in the housing, refrigerant conduit means in the housing connecting said single compressor and the evaporators of said ice maker and said beverage cooling and dispensing system for flow of refrigerant from the compressor through said evaporators and then back to said compressor to effect a refrigeration cycle, a hot gas bypass line and regulator associated with said refrigerant conduit means for directing some of the gas flowing from an outlet of the compressor to an inlet of the compressor in the event the supply of refrigerant from the evaporators to the inlet of the compressor drops below a predetermined amount, and a desuperheating thermal expansion valve operable to introduce a liquid into said hot gas bypass line to cool gas flowing therethrough.

2. A stand-alone combination ice maker and beverage dispenser as set forth in claim 1 further comprising a thermal expansion valve associated with each evaporator for regulating the flow of refrigerant via said refrigerant conduit means to the evaporator.

3. A stand-alone combination ice maker and beverage dispenser as set forth in claim 1 further comprising a sensor in said tank adjacent the evaporator for sensing the build-up of ice on the evaporator and for generating a signal in the event such build-up exceeds a predetermined amount, and valve means operable in response to said signal for shutting off the flow of refrigerant to said evaporator.

4. A stand-alone combination ice maker and beverage dispenser, comprising a housing, an ice making device having a series of compartments in which water is adapted to be frozen to form ice cubes, and an evaporator in the housing for freezing water in the compartments to form ice therein, a beverage cooling and dispensing system comprising a tank in the housing for holding a liquid, an evaporator in the tank for chilling said liquid, at least one beverage conduit positioned in the tank for exposure to chilled liquid to cool beverage flowing through the conduit, and at least one dispensing head connected to said at least one beverage conduit for dispensing beverage supplied via said beverage conduit to said dispensing head, a single compressor in the housing, refrigerant conduit means in the housing connecting said single compressor and the evaporators of said ice maker and said beverage cooling and dispensing system for flow of refrigerant from the compressor through said evaporators and then back to said compressor to effect a refrigeration cycle, and a sensor in said tank adjacent the evaporator sensing the build-up of ice on the evaporator and generating a signal in the event such build-up exceeds a predetermined amount, and valve means which operates solely in response to said signal to shut off the flow of refrigerant to said evaporator.

* * * * *